US011834764B2

(12) United States Patent
Rutz et al.

(10) Patent No.: US 11,834,764 B2
(45) Date of Patent: Dec. 5, 2023

(54) APPARATUS FOR DRAWING-OFF A WEB-SHAPED PRODUCT FROM A WEAVING MACHINE

(71) Applicant: Lindauer DORNIER Gesellschaft mit beschraenkter Haftung, Lindau (DE)

(72) Inventors: Andreas Rutz, Lindau (DE); Markus Reich, Kisslegg (DE)

(73) Assignee: Lindauer DORNIER Gesellschaft mit beschraenkter Haftung, Lindau (DE)

( * ) Notice: Subject to any disclaimer, the term of this patent is extended or adjusted under 35 U.S.C. 154(b) by 989 days.

(21) Appl. No.: 16/633,032

(22) PCT Filed: Jul. 11, 2018

(86) PCT No.: PCT/EP2018/068756

§ 371 (c)(1),
(2) Date: Jan. 22, 2020

(87) PCT Pub. No.: WO2019/025143

PCT Pub. Date: Feb. 7, 2019

(65) Prior Publication Data

US 2020/0208310 A1 Jul. 2, 2020

(30) Foreign Application Priority Data

Aug. 1, 2017 (DE) ..... 10 2017 213 255.8

(51) Int. Cl.
*D03D 49/20* (2006.01)
*D03D 49/04* (2006.01)
(Continued)

(52) U.S. Cl.
CPC ..... *D03D 49/02* (2013.01); *D03D 49/04* (2013.01); *D03D 49/06* (2013.01); *D03D 49/12* (2013.01);
(Continued)

(58) Field of Classification Search
CPC ..... D03D 49/04; D03D 49/06; D03D 49/08; D03D 49/10; D03D 49/12; D03D 49/14;
(Continued)

(56) References Cited

U.S. PATENT DOCUMENTS 620,589 A * 3/1899 Hoxie ..... D03D 49/20
226/171
745,121 A * 11/1903 Taylor ..... D03D 49/08
188/83
(Continued)

FOREIGN PATENT DOCUMENTS

DE 2 314 889 10/1974
DE 101 37 939 3/2003
(Continued)

OTHER PUBLICATIONS

English translation of the International Search Report of the International Searching Authority for International Application PCT/EP2018/068756, dated Aug. 27, 2018, 2 pages, European Patent Office, HV Rijswijk, Netherlands.
(Continued)

*Primary Examiner* — Katharine G Kane
(74) *Attorney, Agent, or Firm* — MARSHALL, GERSTEIN & BORUN LLP; Michael P. Furmanek

(57) ABSTRACT

An apparatus for drawing-off a web-shaped product from a weaving machine in a drawing-off direction includes: at least one clamp carrier having clamps for the web-shaped product; a carrier frame apparatus on which the clamp carrier is guided; a drive arrangement by which the clamp carrier is drivable back and forth in a motion range; and a support system for the web-shaped product. The support system is arranged in an area between the apparatus side facing toward the weaving machine and the clamp carrier, within the carrier frame apparatus, in such a manner so that
(Continued)

a sagging of the web-shaped product in this area is avoided or limited by the support system.

9 Claims, 14 Drawing Sheets

(51) Int. Cl.
*D03D 49/06* (2006.01)
*D03D 49/12* (2006.01)
*D03D 49/18* (2006.01)
*D03D 49/02* (2006.01)

(52) U.S. Cl.
CPC ..... *D03D 49/18* (2013.01); *B65H 2701/174* (2013.01)

(58) Field of Classification Search
CPC ..... D03D 49/16; D03D 49/18; D03D 49/22; B65H 2701/174; B65H 20/18; B65H 20/0322
See application file for complete search history.

(56) References Cited

U.S. PATENT DOCUMENTS

| | | | | |
|---|---|---|---|---|
| 2,990,091 | A | 6/1961 | Goldsworthy et al. | |
| 3,556,888 | A | 1/1971 | Goldsworthy | |
| 3,819,073 | A | 6/1974 | Asselborn et al. | |
| 3,935,724 | A | 2/1976 | Finsterwalder et al. | |
| 4,478,360 | A | 10/1984 | Patkos | |
| 4,534,386 | A * | 8/1985 | Pfarrwaller | D03D 49/12 139/97 |
| 4,712,493 | A | 12/1987 | Aso et al. | |
| 4,769,106 | A | 9/1988 | Busching | |
| 5,341,547 | A | 8/1994 | Rutz | |
| 5,423,354 | A | 6/1995 | Herrlein | |
| 6,092,709 | A * | 7/2000 | Schoenbeck | B65H 20/18 226/173 |
| 10,487,425 | B2 | 11/2019 | Veil | |
| 2004/0250669 | A1 * | 12/2004 | Kienzle | B65H 35/04 83/175 |
| 2009/0284575 | A1 | 11/2009 | Verhoest et al. | |
| 2016/0158997 | A1 | 6/2016 | Resch et al. | |

FOREIGN PATENT DOCUMENTS

| | | |
|---|---|---|
| DE | 202 09 957 U1 | 11/2003 |
| DE | 102015222142 | 12/2016 |
| EP | 1 744 079 | 1/2007 |
| GB | 210087 | 5/1925 |
| JP | 2007-039231 A | 2/2007 |
| JP | 2015-147630 A | 8/2015 |

OTHER PUBLICATIONS

English translation of PCT International Preliminary Report on Patentability of the International Searching Authority for International Application PCT/EP2018/068756, dated Aug. 1, 2019, 6 pages, European Patent Office, Munich, Germany.

* cited by examiner

Fig. 7a
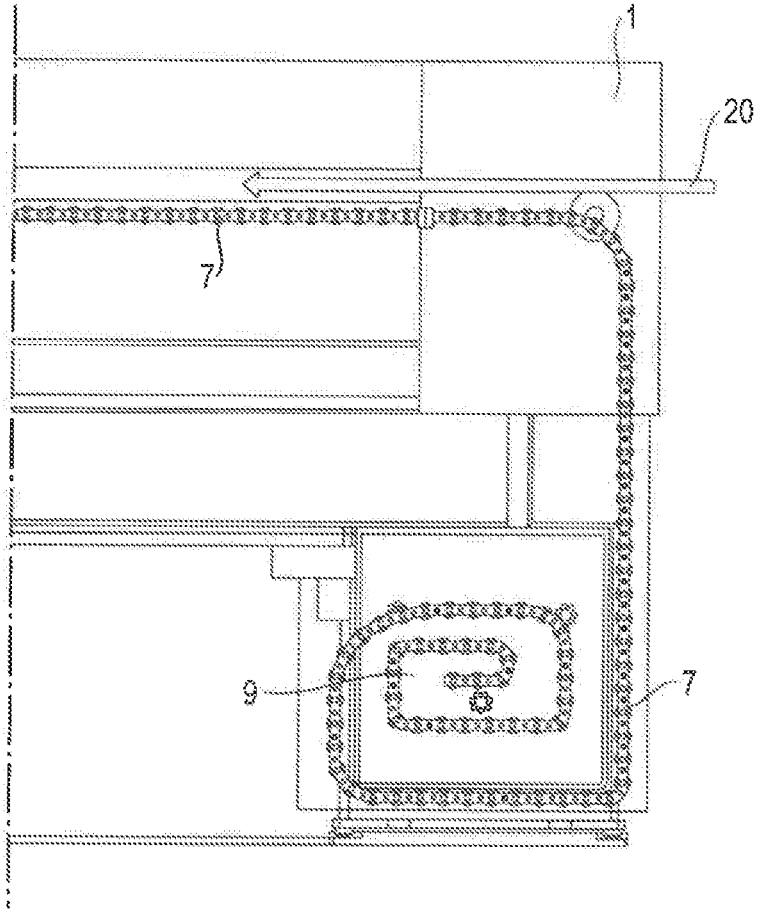
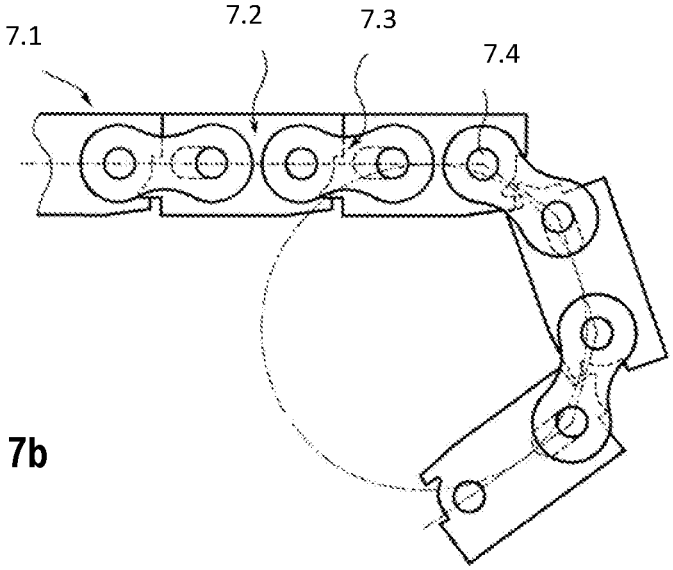
Fig. 7b

APPARATUS FOR DRAWING-OFF A WEB-SHAPED PRODUCT FROM A WEAVING MACHINE

FIELD OF THE INVENTION

The invention relates to an apparatus for drawing-off a web-shaped product from a weaving machine.

BACKGROUND INFORMATION

Apparatuses for drawing-off web-shaped products from weaving machines are known. They are always utilized when web-shaped products, especially woven webs, are produced continuously or section-wise, whereby the produced web-shaped products after being drawn-off from the weaving machine are wound-up or rolled-up, in order to supply them to a further processing or treatment process.

An apparatus for producing and for drawing-off a web-shaped product is known from DE 10 2015 222 142 B3. Two clamp carriers with clamps serve for drawing-off the web-shaped product from the weaving machine, wherein moreover drive means are provided, by which the clamp carriers are driven back and forth in the drawing-off direction of the web-shaped product. Drawing-off the web-shaped product is achieved through the back and forth motion of the clamp carriers in connection with the controlled opening and closing of the clamps, wherein a tensile stress or tensioning is applied to the web-shaped product with the clamps through an actuation of the drive means for the clamp carriers. According to this known apparatus, the web-shaped product is produced with main sections and auxiliary sections. The auxiliary sections serve so that the clamps grasp the web-shaped product at these sections, that is to say an opening and a closing of the clamps are carried out only in the time segments of producing the web-shaped product in which an auxiliary section for holding the web-shaped product is being produced.

An apparatus for feeding cardboard webs or paper webs to printing, stamping or embossing machines is known from GB 210 087 A. For feeding the paper webs or cardboard webs, a fixed stationary supporting substrate in the form of a continuous and planar plate is provided, over which the cardboard or paper material that is to be printed, stamped out or embossed is guided in a sliding manner. That is to say, the plate is rigidly mounted, and the cardboard or paper web slides over it. A corresponding printing, stamping or embossing die is arranged over it so that the cardboard or paper webs are guided between the supporting substrate and the die. In order to be able to print or stamp-out or emboss the cardboard or paper material, an intermittent operation of the feeding device is provided. For that, the cardboard or paper web is clamped before and after the supporting substrate. This clamping does not serve for the drawing-off of the cardboard or paper web, but rather merely for the fixed arresting and securing of a fixed resting contact of the cardboard or paper web on the supporting substrate, so that the die can correspondingly print, stamp-out or emboss.

SUMMARY OF THE INVENTION

The object underlying the invention is now directed to producing an apparatus for drawing-off a web-shaped product from a weaving machine, which is utilizable for thick wares, especially for so-called 3D-wares for example for multi-layered woven webs or fabrics, whereby by means of this apparatus a sagging of the finished produced section of the web-shaped product shall be minimized or entirely avoided.

This object can be achieved by an apparatus for drawing-off a web-shaped product from a weaving machine with the features set forth herein.

The apparatus according to the invention for drawing-off a web-shaped product from a weaving machine comprises at least one clamp carrier, which comprises clamps for the web-shaped product, a carrier frame apparatus, on which the clamp carrier is guided, and a drive means through which the clamp carrier is drivable back and forth in a motion range in the drawing-off direction of the web-shaped product from the weaving machine. In that regard, the drawing-off preferably is achieved horizontally. In the scope of this invention, the term "web-shaped product" is to be understood as covering especially three-dimensionally embodied web-shaped products, which preferably involve multi-layered woven webs or fabrics. According to the invention, the clamp carrier is embodied so that it can clampingly hold the web-shaped product within the motion range of the clamp carrier. According to the invention, a support system for the web-shaped product is provided at least between an apparatus side that faces toward the weaving machine, and the clamp carrier within the carrier frame apparatus. Therewith, an impermissibly large sagging between the apparatus side and the clamp carrier is avoided. The web-shaped product is graspable by the clamp carrier on the weaving machine, and is guidable in its drawing-off direction essentially at the production speed. Above all, the support system serves to be able to draw-off thick yet to some extent flexible web-shaped products from the weaving machine, without allowing its sagging in the apparatus for drawing-off the web-shaped product. Namely, for three-dimensional, for example multi-layered, embodied web-shaped products, the danger exists that due to the self-weight an impermissibly large sagging arises, through which the inner structures of the three-dimensional embodied web-shaped product are deformed, which results in a loss of quality.

By the support system, the web-shaped product is supported so that in any case only a small sagging of the product is present. Here, products with a thickness of approximately 6 to 20 mm or as the case may be even in the range from 40 to 100 mm or more are referred to as very thick or also multi-layered web-shaped products. Such three-dimensionally embodied web-shaped products can no longer be wound or wrapped up on a cloth beam or a winding take-up roller. Thereby this three-dimensionally embodied web-shaped product would be damaged and deformed in its inner structure. Therefore, very thick web-shaped products generally must be drawn-off horizontally out of the weaving machine, namely in the warp direction, so that the individual layers or the individual threads forming the three-dimensional structure are not shifted or deformed. Depending on the application or utilization, the product sections to be held and to be supported within the apparatus can be relatively long, so that the avoidance of the sagging is of utmost importance.

The possibly arising sagging of the web-shaped product section is dependent on the width of the apparatus, that is to say on the width of the carrier frame apparatus, on the tensile stress of the clamp carrier, which pulls-in the product section from the weaving machine into the apparatus for the drawing-off, on the length of the produced section, and on the weight per unit area of the web-shaped product. It has now been shown that the product section can be held, by the support system according to the invention, in such a planar manner in the apparatus so that the woven web quality in the width direction and the longitudinal direction is not impaired by an impermissibly large sagging.

Preferably still a second clamp carrier is provided between the side of the apparatus that faces away from the weaving machine, and the first clamp carrier. The web-shaped product is held in a clamped manner at least temporarily by the first and by the second clamp carrier. That means that the web-shaped product is clampingly held at its leading end, and is at least temporarily similarly clampingly held at its trailing end which faces toward the apparatus side of the weaving machine.

Preferably the support system is embodied in the form of tension cables or stiff-backed chains, or tension cables and stiff-backed chains in combination. In that regard, the support system is movable in the drawing-off direction at a speed corresponding to the production speed of the web-shaped product. In that the support system is movable at a speed corresponding to the production speed of the product section, it is ensured that undesired friction that possibly could damage the product does not arise on the support system.

According to a further development of the invention, the first or as the case may be, the second clamp carrier drives the tension cables and/or the stiff-backed chains, whereby preferably the tension cables are windable into a cable winder or the stiff-backed chains are slidable into a chain storage unit, or can be pulled out of these. The cable winder and/or the chain storage unit serve to wind up the support system during the back and forth motion of the clamp carrier or carriers, or to unwind it from such a storage unit. The advantage of working with a winding-up or unwinding storage unit exists in that, among other things, the working length of the apparatus is easily adaptable to changed desired lengths of a product section.

The term "stiff-backed chains" or also so-called thrust chains is understood to cover such chains that consist of several chain links arranged one after another and connected by chain pins or bolts, which are embodied so that a bending or kinking of the chain links about the axis of the chain pins is possible in one direction, but in the other direction a kinking beyond a straight arrangement of the chain links is blocked. Example embodiments of such chains can be seen e.g. in the EP 1744079 A1, the DE 20209957 U1 or DE 10137939 A1. Thus, these chains can be pushed in the production direction as a support under the product, without departing from their support plane serving for the support of the product sections.

Preferably the tension cables or the stiff-backed chains are movable in the longitudinal direction of the product section and parallel to one another. That means, that over the width of the carrier frame apparatus, within which the product section is guided by means of the clamp carriers, the tension cables and/or the stiff-backed chains are arranged next to one another in such a manner so that a support or contact surface plane is formed, namely the support plane, which guarantees a uniform supporting of the product section, so that this is guidable within the apparatus largely free of sagging, and namely free of sagging especially in the longitudinal direction which corresponds to the drawing-off direction.

The support system with at least two stiff-backed chains, of which the motion is synchronized among one another, is provided preferably in the area between the apparatus side that faces toward the weaving machine, and the first or—if present—the second clamp carrier. The provision of only two stiff-backed chains is above all expedient or suitable when on the one hand the cost, effort or complexity for the support system is to be maintained within limits, but on the other hand, the product section comprises a certain self-stiffness, so that the product section does not or at least does not significantly sag between the two stiff-backed chains in which a direct support of the woven web section is not given.

Preferably each clamp carrier is provided with respectively one upper and one lower clamp bar as a clamp, which are mounted on clamp bar bodies within the clamp carrier, whereby the tension cables and/or the stiff-backed chains or the thrust chains are guided through openings in the respective lower clamp bar bodies. In that regard it is expedient or suitable that the openings comprise such a size that a necessary clamp stroke or travel of the respective lower clamp bar for a clamping of the product section can be carried out without the tension cables and/or the stiff-backed chains being deflected out of their support plane.

Instead of clamp bars, in principle hook- or needle-shaped elements can be utilized in order to fix the web-shaped product on the clamp carriers. Thus, for example, bars with hook-shaped elements mounted thereon or with needles can be mounted on the upper and/or lower clamp carriers. When carrying out the vertical clamping stroke, the hooks or needles submerge or penetrate into the web-shaped product. In order to avoid damaging the ground material, in these cases it is necessary to provide the web-shaped product with auxiliary sections at certain spacing distances, which auxiliary sections are later cut off.

According to a further example embodiment, the tension cables and/or the stiff-backed chains are embodied as endless elements. In such a case, the previously mentioned winding-up devices or unwinding devices are omitted. Instead, deflecting elements—for example cable rollers or chain wheels—are provided, in order to deflect the tension cables or chains out of the drawing-off direction into the opposite direction within the apparatus. This leads to a structurally simplified embodiment, which can be expedient or suitable for an always constant length of the product sections to be produced.

Further preferably, the tension cables and/or stiff-backed chains are able to be wound-up and unwound with the motion of the first or, as the case may be, the second clamp carrier in the drawing-off direction of the web-shaped product. For that, a winding-up or unwinding unit is integrated in the respective clamp carrier, so that this or the entire apparatus can be embodied in a compact manner.

An unclaimed support system comprises a lifting table arranged within the carrier frame apparatus, which is transportable from a retracted position into a support position that supports the product section on its underside and essentially avoids its sagging. A lifting table system consisting of several lifting tables can also be provided.

A similarly unclaimed support system, which supports the web-shaped product on its underside between the first or if applicable the second clamp carrier and the weaving machine, comprises a scissors rod linkage system with e.g. carrier rolls, slide rails, slide sheets, tension cables. The advantage of such a scissors rod linkage system exists above all in that the support length for the product section to be supported in the apparatus is relatively easily adaptable to different lengths of the product section.

The carrier rolls, slide rails, slide sheets or tension cables are arranged in the scissors rod linkage system in such a manner so that their respective surfaces that face in the direction toward the product section to be supported form the support plane. The scissors rod linkage system is transportable from its extended, stretched condition into its retracted "crushed or compressed" condition in a length ratio of preferably approximately 3:1. With a length of the apparatus of preferably 6 m, the crushed or compressed length amounts to approximately 2 m. In order to keep the woven web waste small, therefore it can further be provided that the scissors rod linkage system is transportable downwardly into an area below the clamp carrier, which is especially realizable by means of a guide rail in the manner of a sliding block guide.

BRIEF DESCRIPTION OF THE DRAWINGS

Further advantages, embodiments and details of the present invention will now be described in connection with the figures according to several example embodiments.

In the drawings, it is shown by:

FIGS. 7*a,b* a side region of the apparatus according to the invention according to the FIGS. 1-3, with a support system embodied as a thrust chain, of which the thrust chain can be received in a storage unit and there again be unwound;

DETAILED DESCRIPTION OF EXAMPLE EMBODIMENTS OF THE INVENTION

Figure 5:
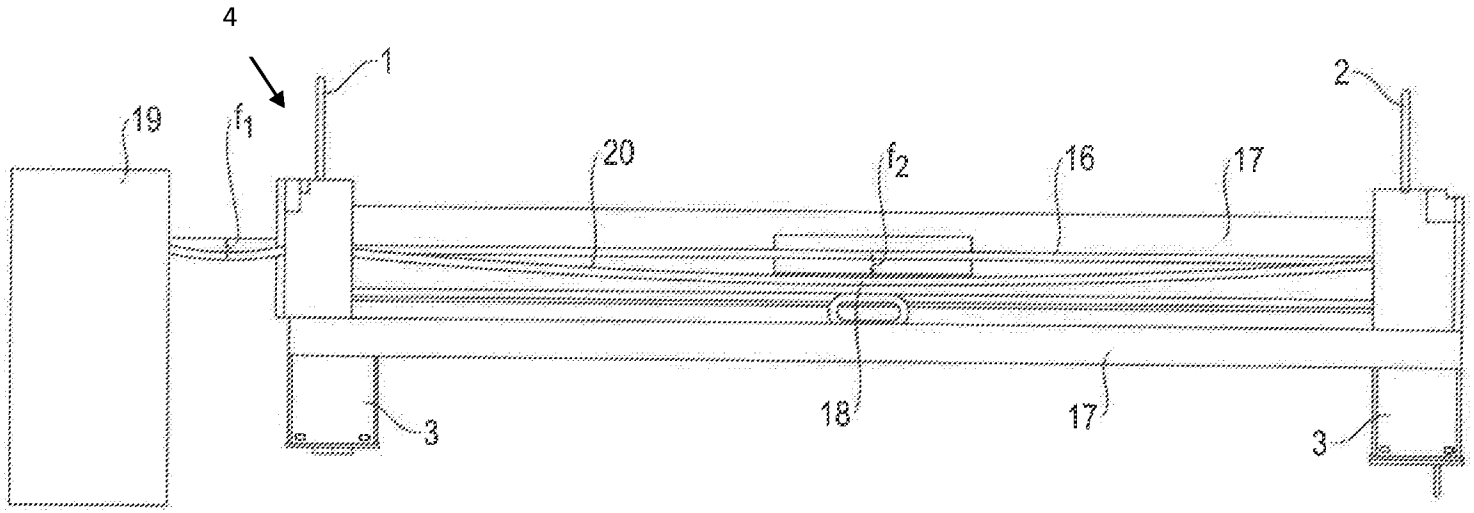
FIG. 5 a side view of an apparatus according to the prior art with principle illustration of the sag f of the web-shaped product within the carrier frame apparatus as well as in the area between the weaving machine and the apparatus for drawing-off the web-shaped product.

In a side view in a principle or schematic illustration, FIG. 5 shows an apparatus for drawing-off the web-shaped product 20 according to the prior art. FIG. 5 represents a sectional view of the apparatus in the longitudinal direction thereof. The apparatus includes two clamp carriers 1, 2, a carrier frame 3, drive spindles for the two clamp carriers 16, covers 17 and a weaving machine 19. The produced web-shaped ware, that is to say the web-shaped product 20, is illustrated between the clamp carrier 1 and the clamp carrier 2, and in the middle comprises a sag 18 ($f_2$). The apparatus according to the present invention avoids or limits this sag. In order that also a sag f1 between the weaving machine 19 and the drawing-off apparatus is avoided, it is additionally advantageous if the drawing-off apparatus is placed as close as possible to the weaving machine 19.

Figure 1:
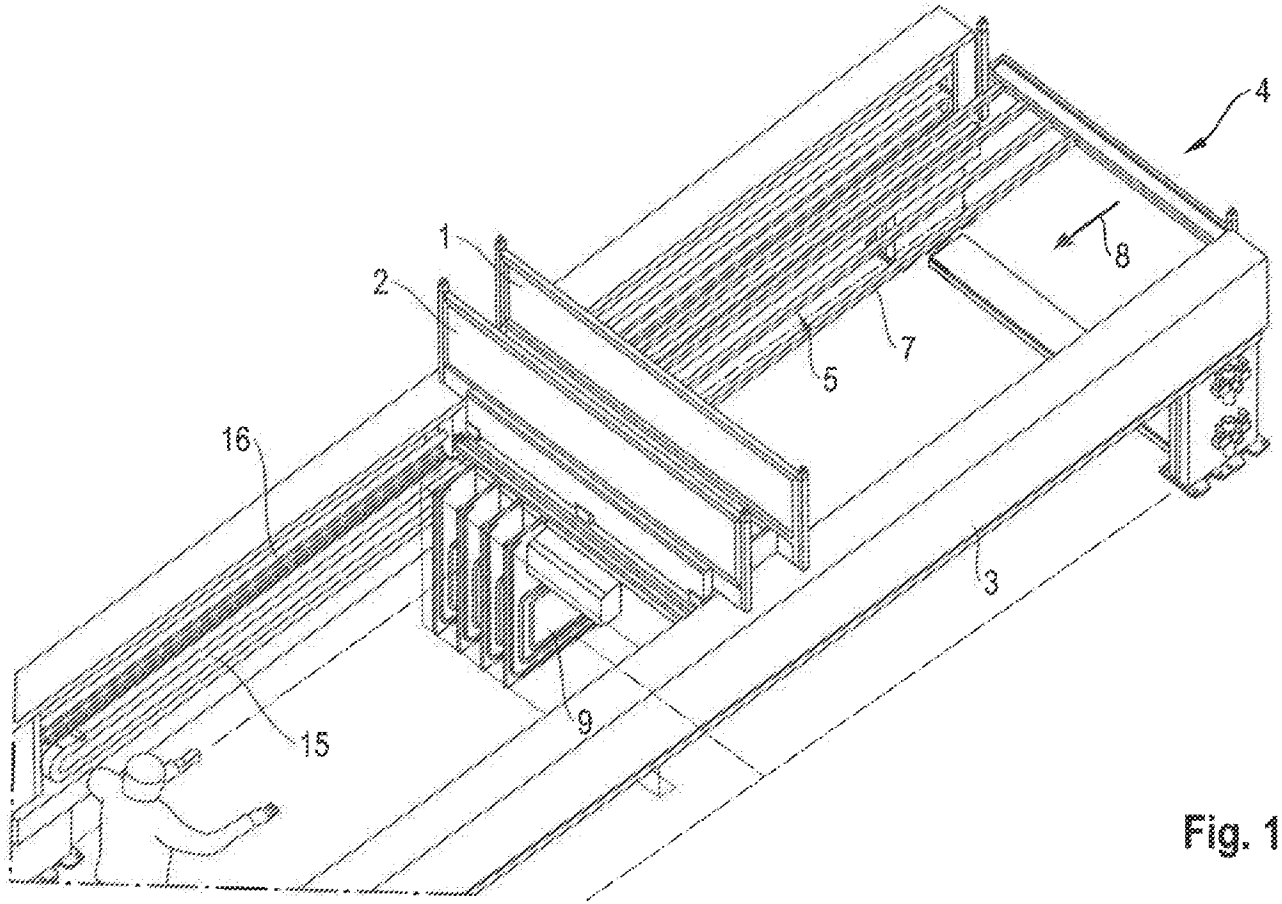
FIG. 1 a perspective view of an apparatus according to the invention for drawing-off a web-shaped product from a weaving machine according to a first example embodiment.

A perspective view of a first embodiment of the apparatus according to the invention is illustrated in FIG. 1. The apparatus is arranged with its apparatus side 4 facing toward the weaving machine in the drawing-off direction 8, so-to-speak next to the non-illustrated weaving machine or bordering thereon. In the example of FIG. 1, a carrier frame apparatus 3 carries a first clamp carrier 1 and a second clamp carrier 2, wherein the latter comprises a chain storage unit 9, in which stiff-backed chains 7 that are provided as a support system 5 are arranged. The number of the stiff-backed chains 7, in the present example four of such chains 7 are illustrated, is determined dependent on the width of the web-shaped product produced by the weaving machine as well as depending on its self-stiffness.

A chain storage unit 9 is allocated to the second clamp carrier 2, and the clamp carriers are provided to grasp and to clamp the web-shaped product and to move it at the production speed within the apparatus to its drawing-off. The supporting length of the support system 5 corresponds to the length of the produced web-shaped product up to the second clamp carrier 2; the rest of the support system is in the storage unit, in the embodiment illustrated here it is wound up as a stiff-backed chain 7 in the chain storage unit 9. Thereby, the rear portion of the apparatus, in FIG. 1 the portion illustrated at the bottom left, is freely accessible for maintenance works and operating personnel up to the chain storage unit 9. Spindles 16 are provided on both sides of the carrier frame apparatus 3, which spindles drive the clamp devices 1, 2 back and forth within the carrier frame apparatus via correspondingly allocated drives (not shown). Next to the spindle 16, a cable drag chain 15 is arranged, which ensures a supply or delivery of the corresponding supply lines to the drives of the clamp carriers. The stiff-backed chains comprise a spacing distance relative to one another, which prevents a sagging of the web-shaped product due to a present self-weight, also in the width direction.

When the web-shaped product 20 is produced by the weaving machine, the second clamp carrier 2 grasps or clamps the front leading edge of the web-shaped product and moves the same in a clamping manner at the production speed for the web-shaped product over the desired length of the section to be produced. During the drawing-off, the produced web-shaped product 20 is supported essentially free of sagging on the stiff-backed chains 7. After the produced length of a first section of the web-shaped product 20 is reached, the first clamp carrier 1 grasps the forward edge of the next produced web-shaped product section and maintains the tension between the drawing-off apparatus and the weaving machine. After grasping the web-shaped product section by the first clamp carrier, the clamp of the second clamp carrier 2 can be opened. Next, the second clamp carrier 2 moves back out of the rear region of the drawing-off apparatus, and the produced web-shaped product section can be removed out of the apparatus by the operator. The stiff-backed chains 7 are guided through openings 13 in the clamp carrier 1 and 2. They are again wound up in the chain storage units 9 when the second clamp carrier moves out of the rear region or area of the drawing-off apparatus according to the invention in the direction toward the weaving machine.

As soon as the opened second clamp carrier 2, on its way counter to the drawing-off direction 8, has reached the first clamp carrier 1, the product section grasped by the first clamp carrier is transferred to the second clamp carrier by corresponding control of the clamps and of the drives, and the above described process begins anew.

Figure 2:
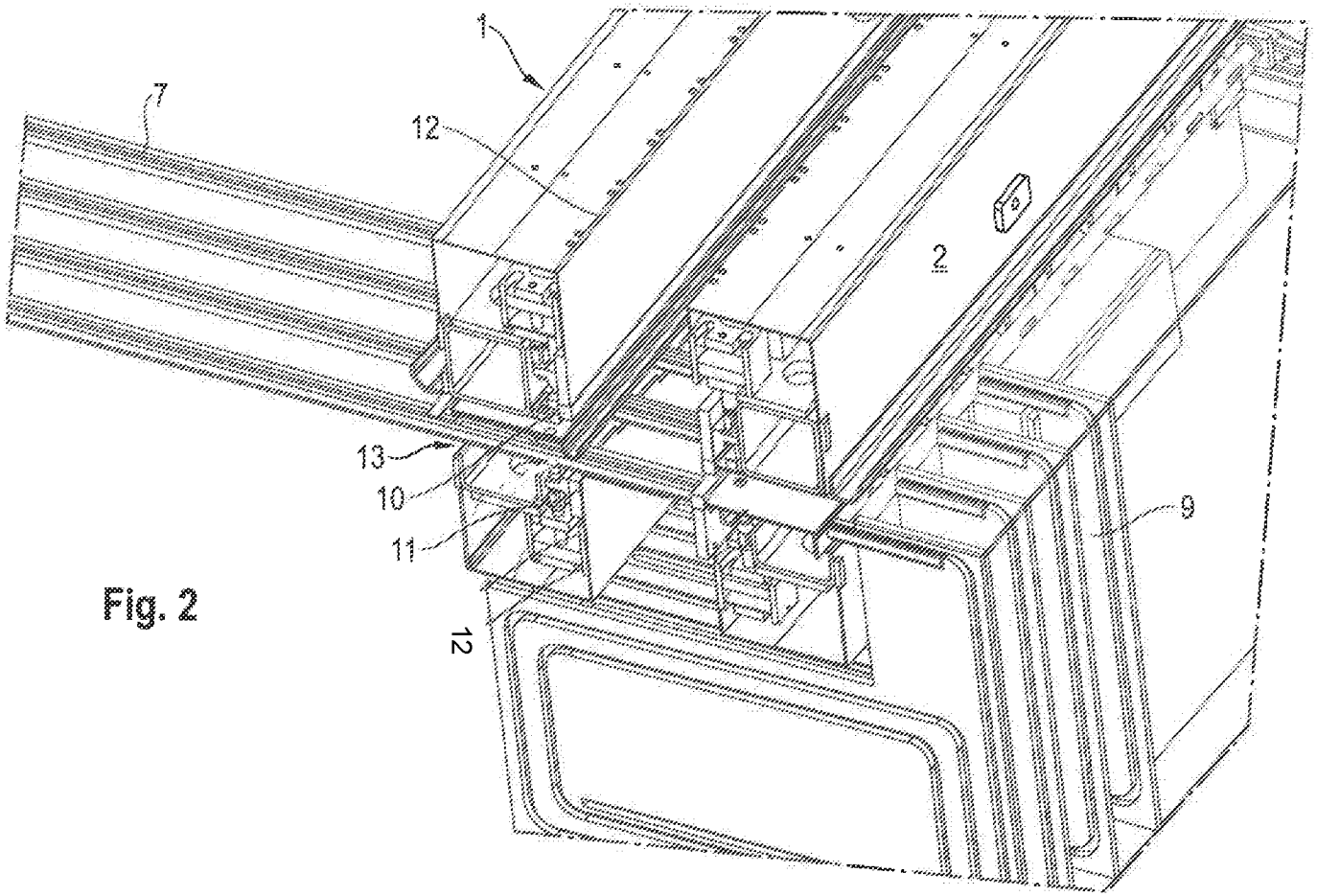
FIG. 2 a detail view of the clamp carrier and of the chain storage unit of an apparatus according to FIG. 1.

A perspective detail view of an upper clamp bar 10 and a lower clamp bar 11, respectively for the first clamp carrier 1 and the second clamp carrier 2, is shown in FIG. 2. The stiff-backed chains 7 are guided through openings 13 through the clamp bar bodies 12 of the clamp carriers 1 and 2, and are guided into the chain storage unit 9 and are wound up there. With a corresponding counter-running motion, the chains in the chain storage unit are again unwound. In the present illustration, the second clamp carrier 2 has nearly closed the clamp bars 10, 11, whereas on the first clamp carrier 1 the upper clamp bar 10 and the lower clamp bar 11 are opened wide. In the region or area of the clamp bars 10, 11, while resting upon the stiff-backed chains 7, the produced web-shaped product 20 is guided through the first clamp carrier 1 and the second clamp carrier 2 in an essentially sag-free manner, so far so that the corresponding clamp bars 10, 11 can become effective for a clamping of the web-shaped product 20.

Figure 3A:
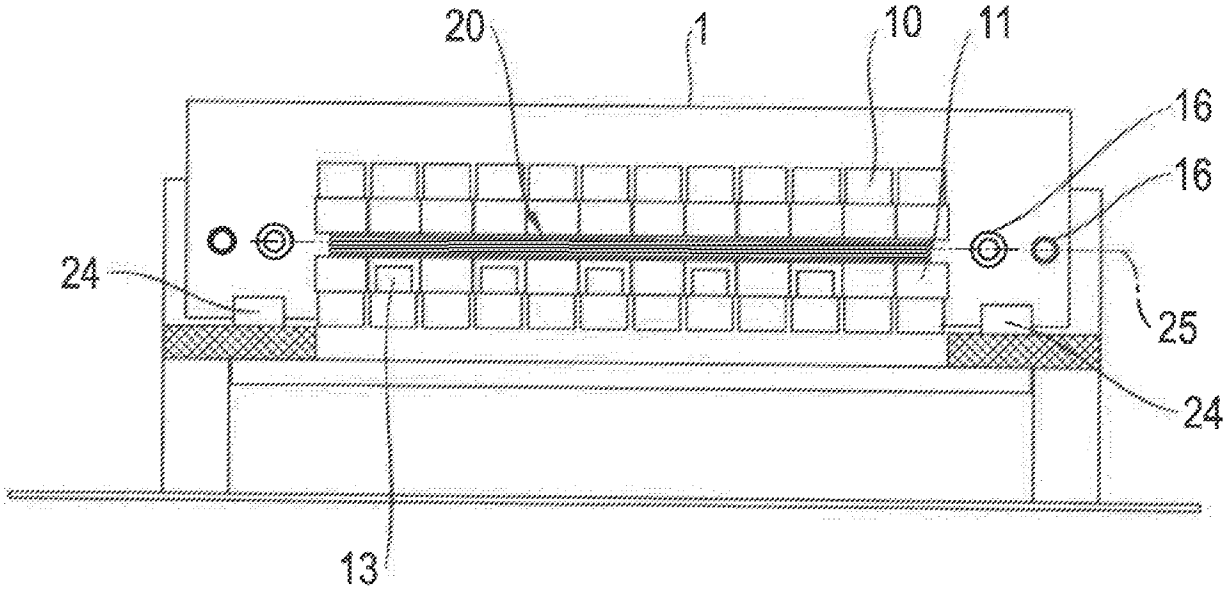
FIG. 3*a* a principle view of the apparatus according to the invention in its longitudinal direction with clamp bars consisting of individual segments.

A principle or schematic view in the direction of the take-down or drawing-off, that is to say in the longitudinal direction of the apparatus for drawing-off the web-shaped product, is illustrated in FIG. 3*a*, in which the web-shaped product 20 is clamped or held in a supported manner between the upper clamp bar 10 and the lower clamp bar 11. Both the upper clamp bar 10 as well as the lower clamp bar 11 are divided into individual segments. Because certain differences in the produced thickness can arise or are purposely produced in that manner during the production of the three-dimensional web-shaped product 20, it is thereby ensured that a slipping or an insufficient clamping does not arise on the respective clamp carrier at any location over the width of the web-shaped product to, be clamped. In the segments that form the lower clamp bar 11, corresponding openings 13 are provided corresponding to the spacing distance for supporting the web-shaped product by the stiff-backed chains 7, through which openings the stiff-backed chains are guided so that a collision with the product 20 to be clamped and the clamp bars is avoided. The illustrated first clamp carrier is guided via guide tracks 24 provided on both sides. The web-shaped product to be clamped extends in the plane 25. Additionally illustrated are the spindles 16, which ensure the secure and reliable and exact drive of the motion of the respective clamp carrier 1, 2.

Figure 3B:
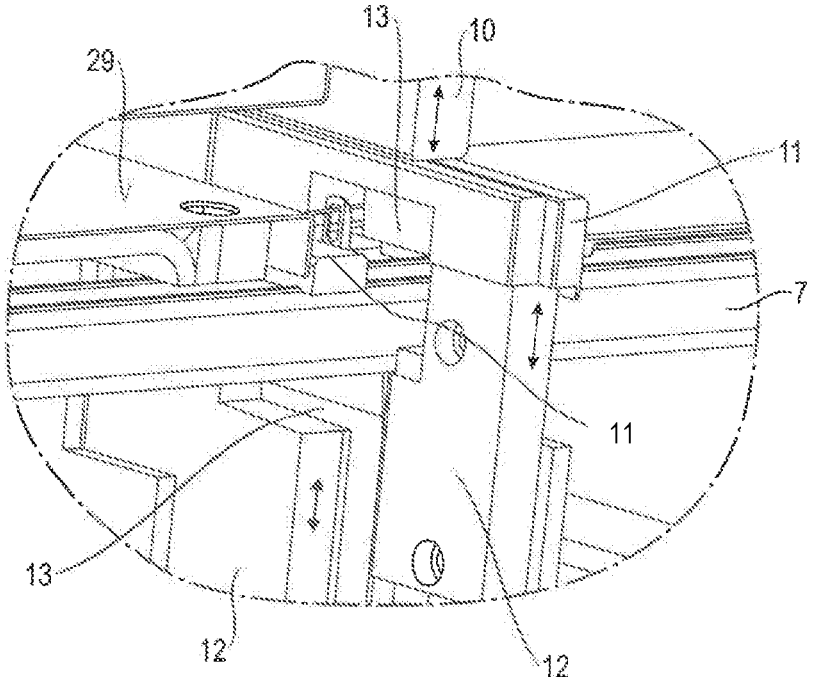
FIG. 3*b* a detail view of the clamp bars for clamping the web-shaped product with openings for leading through the support system according to the invention.

A further detail view of the clamp region or area of the first clamp carrier 1 and the second clamp carrier 2 is illustrated in a perspective illustration in FIG. 3*b*. As an example, only one stiff-backed chain 7 is shown, for which an opening 13 is provided in the respective clamp bar body 12, below the actual clamp region effective between the upper clamp bar 10 and the lower clamp bar 11, through which opening the stiff-backed chain 7 is guided. The openings 13 for guiding through the stiff-backed chains 7 are machined into the clamp bar body 12. Above the stiff-backed chains 7, supporting contact surfaces 29 are provided directly before and after the clamp bars 10, 11, on which supporting contact surfaces the web-shaped product 20 rests, on approximately the same level with the direct clamping surface of the clamp bars 10, 11. A height difference exists between these supporting contact surfaces 29 and the supporting plane on the upper surface of the stiff-backed chain, which height difference is necessary so that the stiff-backed chains 7 can be guided through the clamp bar bodies 12, and in fact below the direct clamp surfaces of the clamp bars 10, 11, and so that on the other hand, a clamping of the web-shaped product at the locations provided for that for the purpose of movement thereof can take place. The two lower clamp bar bodies 12 of the first and second clamp carrier are illustrated, wherein the clamp bar body of the first clamp carrier illustrated on the left in FIG. 3 is moved or driven with its opening 13 so far toward the bottom, so that the stiff-backed chain 7 still just barely glides through with its upper surface on the upper rim or edge of the opening 13. In contrast, the clamp bar body 12 of the second clamp carrier illustrated on the right in FIG. 3 is moved or driven so far toward the top so that the supporting contact surface 29 aligns essentially flush with the direct clamping surface of the upper clamp bar 10 and the lower clamp bar 11.

Figure 4:
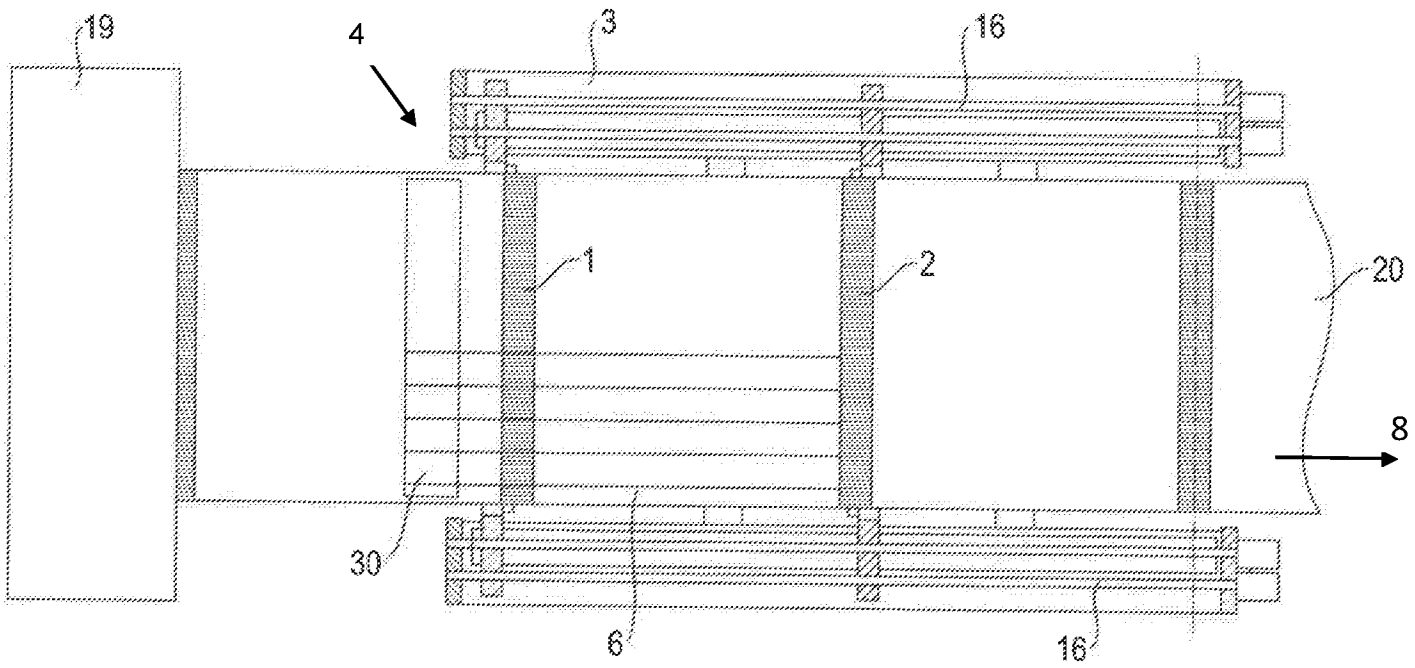
FIG. 4 a principle view of an apparatus according to the invention according to a second example embodiment with cables as the support system.

A further example embodiment is illustrated in FIG. 4, in which a number of tension cables 6, arranged essentially in parallel next to one another, is provided as the support system. The tension cables 6 extend within the apparatus according to the invention for drawing-off the web-shaped product 20 between the carrier frame apparatus 3 in the longitudinal direction. In that regard, the tension cables 6 are dimensioned so that with such a tension they can span or cover under tension the region or area between the clamp carriers 1, 2, so that upon supporting contact of the web-shaped product 20 or product section being transported, the tension cables 6 do not sag or only insignificantly sag. The tension cables 6 are secured on a cable winder 30 in the area of the front side 4 of the apparatus and are drawn-off from the cable winder 30 with the motion of the second clamp carrier 2 essentially at the production speed of the web-shaped product 20, so that their drawn-off length corresponds to the just-produced length of the web-shaped product up to the second clamp carrier. The cables are arranged with an essentially constant spacing distance relative to one another. Depending on the produced width of the web-shaped product 20, tension cables not needed for the support can be disengaged, so that only so many tension cables 6 arranged next to one another are drawn-off under tension from the cable winder 30 by means of the second clamp carrier 2, as is required by the width of the produced web-shaped product 20 for avoiding a sagging of the product. From FIG. 4 it can be seen that the web-shaped product 20 is produced by the weaving machine 19 and transferred to the apparatus for drawing-off the web-shaped product. The two sides of the carrier frame apparatus 3 are illustrated in a principle or schematic illustration, wherein respectively corresponding spindles 16 are arranged, on which the clamp carriers 1, 2 are guided in a bearing-supported and movable manner.

Figure 6A:
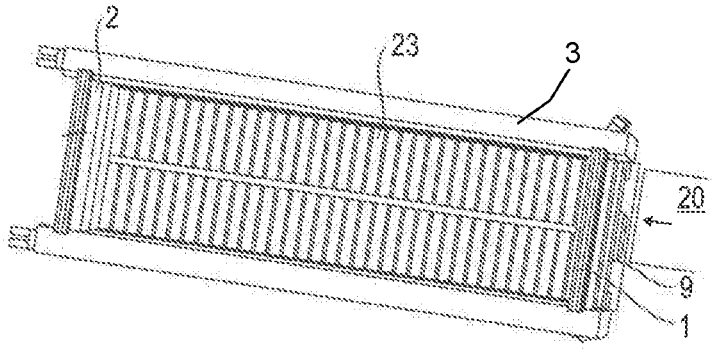
FIG. 6*a* an apparatus according to the invention for drawing-off a web-shaped product according to a third example embodiment with two carrier roll trains lying next to one another as the support system.

A further example embodiment according to the invention is illustrated in FIG. 6*a*, in which the support system 5 is embodied by two carrier roll trains 23 arranged next to one another. The web-shaped product 20 runs through the apparatus according to FIG. 6*a* in the drawing-off direction from the right toward the left. A chain storage unit 9 is provided on the carrier frame apparatus 3 on the right side at the inlet of the web-shaped product 20 into the apparatus for drawing-off the web-shaped product. On the outlet end of the apparatus according to the invention, the second clamp carrier 2 is illustrated, on which the other end of the chains 7 is secured, on which the carrier rolls 23 are bearingly supported. The spacing distance between the carrier roll trains, which are arranged next to one another in a parallel orientation relative to one another, can be adapted depending on the self-stiffness of the produced web-shaped product 20.

Figure 6B:
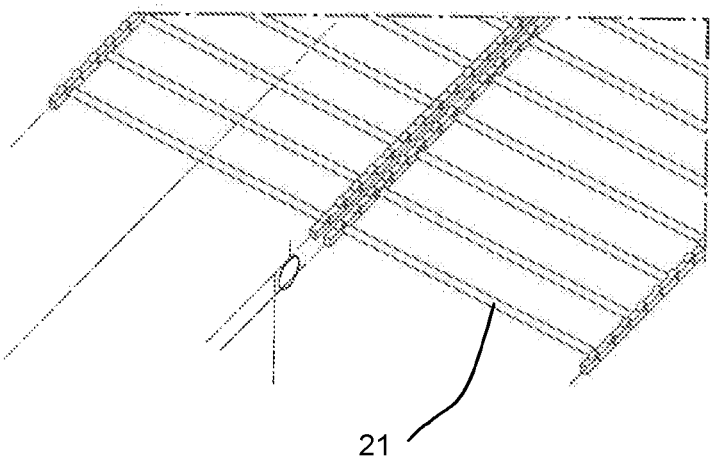
FIG. 6*b* a detail view of the two carrier roll trains arranged next to one another within the carrier frame apparatus according to FIG. 6*a;*

The example embodiment according to FIG. 6*a* is shown in an enlarged illustration in FIG. 6*b*. From that it becomes evident that the individual carrier rolls 21 are connected on both sides respectively with a stiff-backed chain or thrust chain, so that the support system 5 according to this example embodiment similarly can be transported through the apparatus for drawing-off the web-shaped product at the production speed of the web-shaped product 20, without the same sagging, because this support system 5 with the carrier rolls 21 is embodied so that the self-stiffness or inherent rigidity essentially prevents a sagging on the intermediate spaces between the carrier rolls, which spaces are not directly supported by the carrier rolls 21.

Figure 6C:
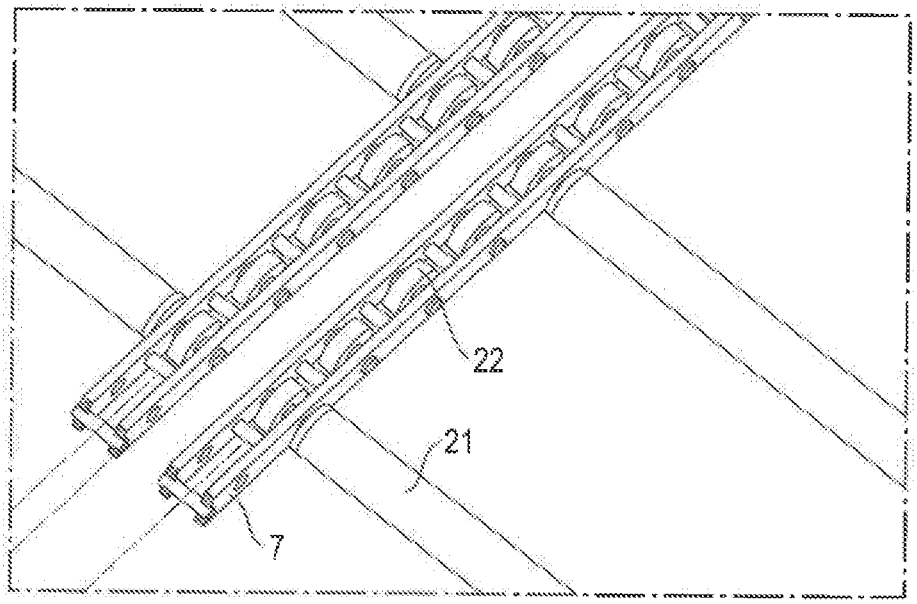
FIG. 6*c* an enlarged detail view of the carrier rolls including their bearing support according to the example embodiment according to FIG. 6*a;*

The thrust chains and respectively two carrier rolls 21 are shown in a once-again enlarged illustration in FIG. 6*c*. From that it becomes evident that on the thrust chain, roller bearings 22 and two adjacent carrier rolls 21 are arranged at a spacing distance relative to one another, which corresponds to the four-fold multiple of the axial spacing distance between the individual roller bearings 22. Depending on the stiffness of the web-shaped product 20, the spacing distance of the carrier rolls 21 can be varied so that in the tightest or narrowest case, one carrier roll 21 is allocated to each individual roller bearing 22.

FIG. 7*a* shows, in a principle or schematic illustration, a side of the apparatus according to the invention for drawing-off the web-shaped product 20, and in fact the example embodiment according to the FIGS. 1 to 3 with stiff-backed chains 7 in the form of thrust chains. One possible embodiment of such a thrust chain 7 is illustrated in FIG. 7*b*. This provides chain links 7.1, 7.2, 7.3 alternating with one another, which are respectively connected with one another via a chain joint. Each chain joint encompasses a chain bolt or pin 7.4. The chain links 7.1 and 7.2, on their end faces in the chain running direction, comprise support or bracing contours. The arrangement of the support or bracing contours is embodied so that the rotating of the chain links about the axis of the chain bolt or pin 7.4 is prevented in one of both possible rotation directions by a contacting of adjacent support or bracing contours. The chain can thus take up forces without kinking in a direction perpendicular to the chain bolts or pins and perpendicular to the longitudinal axis of the chain. This characteristic is also referred to as "stiff-backed". Chain links and support or bracing contours are shown here in an exemplary manner. In order to achieve the described characteristics, other forms and embodiments of such thrust chains are also possible—for example according to the prior art set forth further above.

These thrust chains form a corresponding support region for the produced web-shaped product 20. At one end, these stiff-backed chains 7 are guidable into their respective allocated chain storage unit 9. Upon shortening the required support length, the stiff-backed chain 7 is transported or fed into the chain storage unit 9 and wound-up or rolled-up there. In contrast, upon lengthening the required support region, the chain is unwound out of the chain storage unit 9. If the web-shaped product is to be produced in a larger length, it is certainly expedient or suitable to provide the stiff-backed chains 7 as the support system with a slight curvature or camber toward the top, so that under loading with resting contact of the web-shaped product thereon, the stiff-backed chains are deformed into an essentially planar so-called null position.

Figure 8:
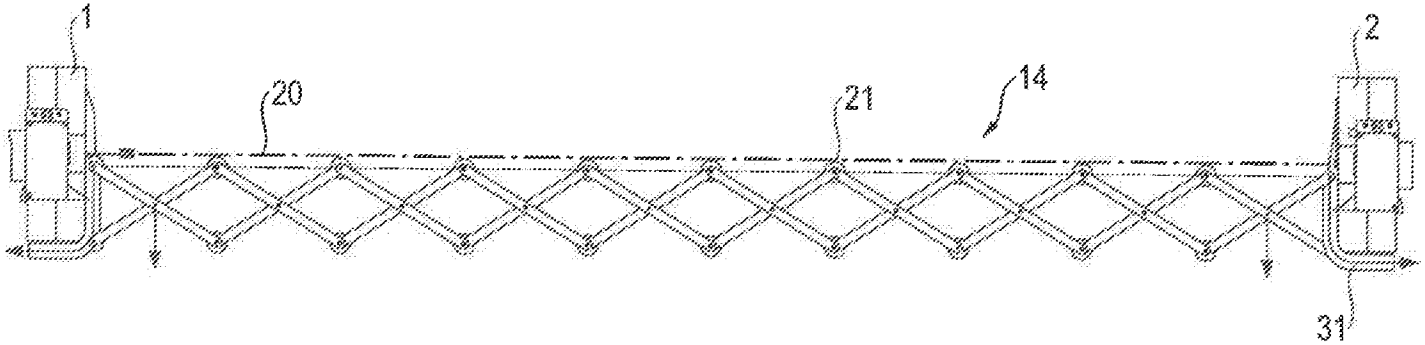
FIG. 8 an unclaimed example of an apparatus for drawing-off a web-shaped product in the form of a scissors rod linkage system as the support system.

An unclaimed example is illustrated in FIG. 8, in which a scissors rod linkage system 14 is present as a support system. Similarly a sag-preventing supporting contact for the web-shaped product 20 is ensured with the support rolls or carrier rolls 21 that are taken up on the scissors rod linkage system 14, and that are freely passively rotating along. Disadvantageous with the scissors rod linkage system 14 is that it must be tilted or folded away by the support system 5 upon shortening the required support length. This is carried out under the clamp carriers 1, 2 by means of a guide rail 31 in the manner of a sliding block guide.

Figure 9:
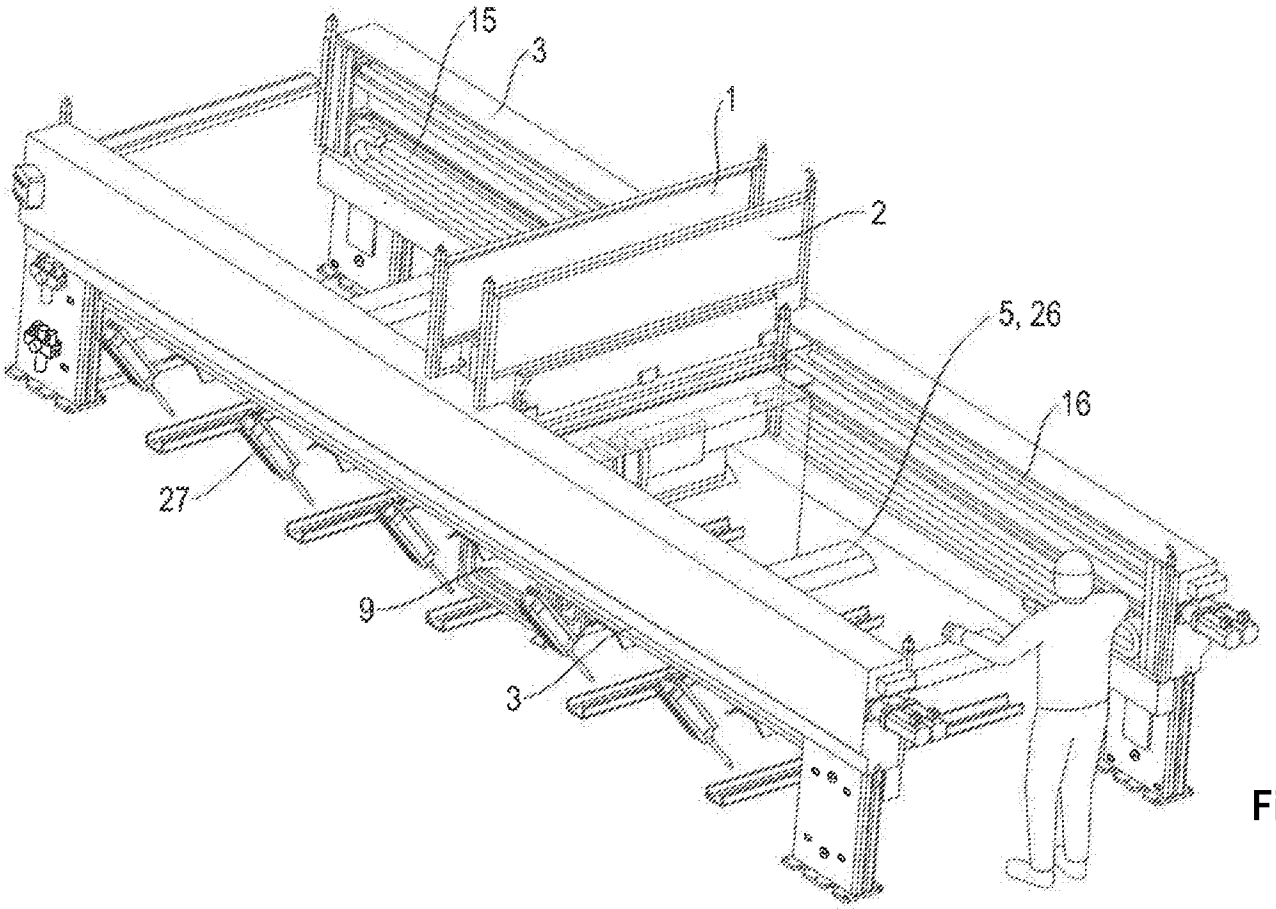
FIG. 9 a perspective view of an unclaimed apparatus with a lifting table system with five lifting tables as the support system.

An unclaimed apparatus for drawing-off a web-shaped product of three-dimensional type is illustrated in FIG. 9, in a principle or schematic arrangement. The identical individual components described in FIG. 1 will not be explained again separately here. The same reference characters in any event mean the same elements. In the apparatus according to FIG. 9, five lifting tables 26 in several segments are illustrated as the support system 5. The lifting tables 26 functioning as the support system 5 are arranged on the floor of the apparatus and comprise a lifting table linkage, which is not illustrated in FIG. 9, which is respectively drivable or movable by means of a hydraulic cylinder 27 in a controlled manner so that the lifting tables 26 are drivable or movable out of their non-supporting position located on the floor upwardly into the supporting position, and in fact up to the plane for the web-shaped product. Thus, the lifting table involves a telescope-like movable supporting contact surface, which is drivable or movable up to the bottom surface of the web-shaped product 20 for its support out of the floor position or non-supporting position into the supporting position.

Figure 10A:
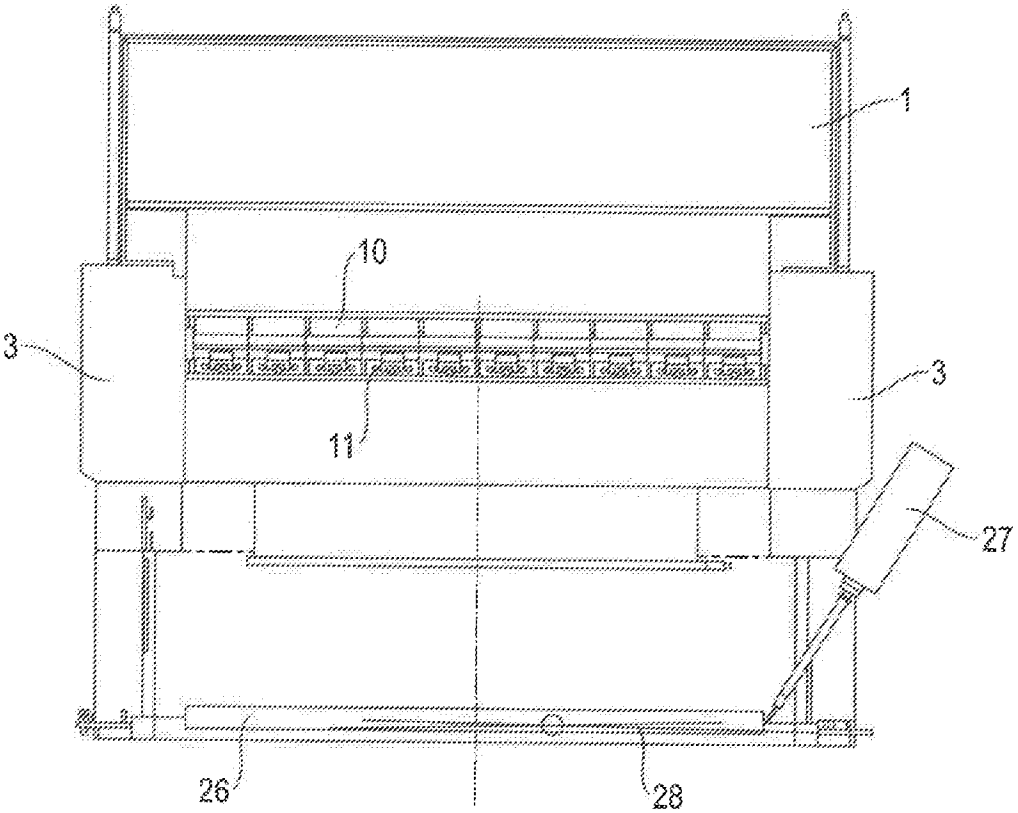
FIG. 10*a* a principle view of the apparatus according to FIG. 9 with the lifting table driven completely downwardly.

In FIG. 10*a*, in the view direction of the longitudinal direction of the apparatus according to FIG. 9, the support system in the form of the lifting table 26 is shown in a non-supporting position arranged on the floor. In that regard, the lifting table linkage 28 is folded together, so that the direct supporting contact surface of the lifting table 26 rests on the foundation of the lifting table on the floor. The lifting table linkage 28 is spreadable by means of, for example, a hydraulic cylinder 27 or pneumatic cylinder or servo motor, whereby the lifting table 26 itself is movable or drivable out of the non-supporting position into the supporting position.

The first clamp carrier 1, which comprises an upper clamp bar 10 divided into individual segments and a lower clamp bar 11 similarly divided into individual segments, is shown in FIG. 10*a*. Furthermore, the carrier frame apparatus 3 is schematically shown.

Figure 10B:
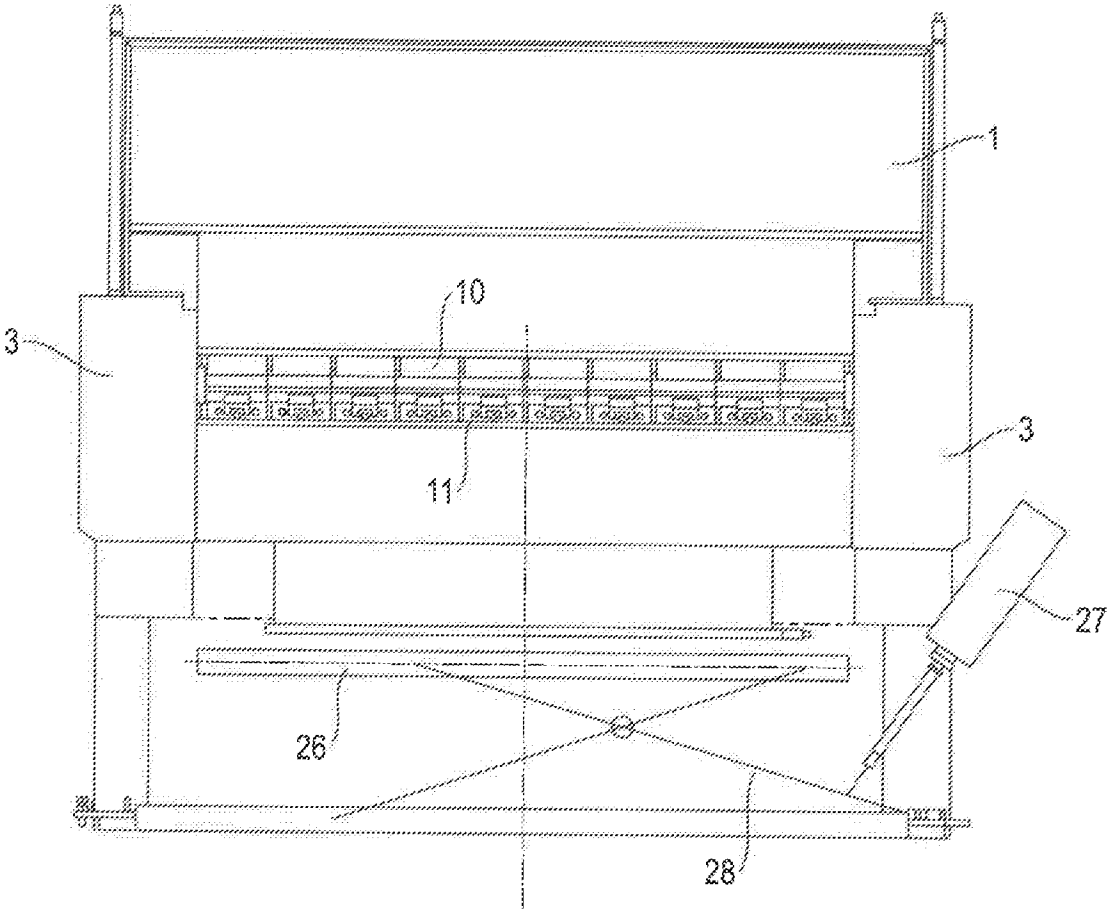
FIG. 10*b* the apparatus according to FIG. 9 with the lifting table partially extended.

The same side view of the apparatus as in FIG. 10*a* is shown in FIG. 10*b*. However, via the drive of the hydraulic cylinder 27, the lifting table linkage 28 has been spread so far that the lifting table has moved from the floor position into an intermediate position. All further elements and details correspond to those of FIG. 10*a*.

Figure 10C:
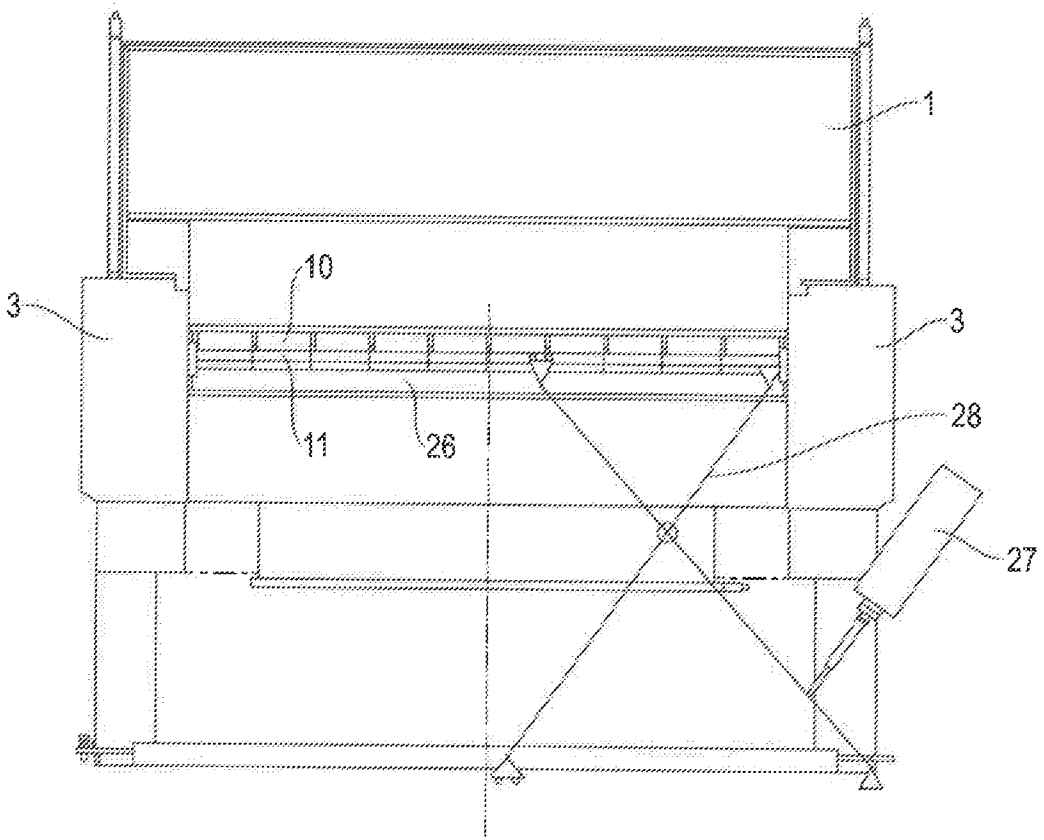
FIG. 10*c* the apparatus according to FIG. 9 with the lifting table extended into the support position.

In FIG. 10*c*, the lifting table linkage 28 is spread so far by means of the hydraulic cylinder 27 so that the lifting table 26 is arranged in the supporting position in the area of the clamp so bars 10, 11. The web-shaped product 20 to be supported, which is not illustrated in FIG. 10*c*, then lies in contact on the lifting table 26, so that a sagging is essentially prevented.

REFERENCE CHARACTER LIST

1 first clamp carrier
2 second clamp carrier

3 carrier frame apparatus
4 apparatus side facing toward the weaving machine
5 support system
6 tension cables
7 stiff-backed chains
8 drawing-off direction
9 storage unit for support system/chain storage unit
10 upper clamp bar
11 lower clamp bar
12 clamp bar body
13 opening
14 scissors rod linkage
15 cable drag chain
16 spindle
17 cover
18 sag
19 weaving machine
20 web-shaped product
21 carrier roll
22 roller bearing
23 carrier roll trains
24 guide track clamp carrier
25 plane web-shaped product
26 lifting table
27 hydraulic cylinder
28 lifting table rod linkage
29 supporting contact surfaces
30 cable winder
31 guide rail scissors rod linkage system

The invention claimed is:

1. An apparatus for drawing-off a web-shaped product from a weaving machine at a production speed in a drawing-off direction, comprising:

at least one clamp carrier that comprises clamps for the web-shaped product, a carrier frame apparatus on which the at least one clamp carrier is guided, a drive arrangement by which the at least one clamp carrier is drivable back and forth in a motion range in the drawing-off direction, and a support system for the web-shaped product, which is drawn-off from the weaving machine at the production speed, wherein the support system comprises tension cables and/or stiff-backed chains that are movable in the drawing-off direction at a speed corresponding to the production speed of the web-shaped product, and wherein the support system is arranged at least in an area between an apparatus side facing toward the weaving machine and the at least one clamp carrier within the carrier frame apparatus, so that a sagging of the web-shaped product in this area is avoided or limited by the support system.

2. The apparatus according to claim 1, wherein the at least one clamp carrier comprises a first clamp carrier and a second clamp carrier, provided, wherein both clamp carrier, are constructed and drivable so that the web-shaped product is held in a clamped manner at least temporarily simultaneously by the first clamp carrier and by the second clamp carrier.

3. The apparatus according to claim 1, wherein the tension cables and/or the stiff-backed chains are drivable back and forth in the drawing-off direction.

4. The apparatus according to claim 1, further comprising a cable winder or a chain storage unit, wherein the tension cables and/or the stiff-backed chains can be wound-up on, or pushed into, or pulled out of the cable winder or the chain storage unit.

5. The apparatus according to claim 1, wherein the support system for the web-shaped product comprises at least two of the stiff-backed chains of which respective motions are synchronized among one another.

6. The apparatus according to claim 4, wherein the cable winder or the chain storage unit is arranged on the apparatus side facing toward the weaving machine or on one of the at least one clamp carrier of the apparatus.

7. The apparatus according to claim 1, wherein at least one of the at least one clamp carrier comprises respectively an upper clamp and a lower clamp respectively embodied as an upper clamp bar and a lower clamp bar, and the tension cables and/or the stiff-backed chains are guided through openings in the respective lower clamp bar, wherein the openings have a size so that a required clamp stroke distance of the respective lower clamp bar for a clamping of the web-shaped product can be carried out, without the tension cables and/or the stiff-backed chains being deflected out of a horizontal arrangement thereof supporting the web-shaped product.

8. The apparatus according to claim 1, wherein the tension cables and/or the stiff-backed chains are endless elements.

9. The apparatus according to claim 1, wherein the web-shaped product is three-dimensional.

* * * * *